US009347450B2

(12) United States Patent
Wang et al.

(10) Patent No.: US 9,347,450 B2
(45) Date of Patent: May 24, 2016

(54) CENTRIFUGAL COMPRESSOR

(71) Applicant: Kangyue Technology Co., Ltd., Shouguang (CN)

(72) Inventors: Hang Wang, Shouguang (CN); Chao Ma, Jinan (CN); Zhifu Zhu, Shouguang (CN); Yongtai Li, Shouguang (CN); Lihua Song, Shouguang (CN); Xilu Guo, Shouguang (CN); Congcong Wang, Shouguang (CN)

(73) Assignee: KANGYUE TECHNOLOGY CO., LTD., Shouguang (CN)

( * ) Notice: Subject to any disclaimer, the term of this patent is extended or adjusted under 35 U.S.C. 154(b) by 710 days.

(21) Appl. No.: 13/749,654

(22) Filed: Jan. 24, 2013

(65) Prior Publication Data

US 2013/0136587 A1 May 30, 2013

Related U.S. Application Data

(63) Continuation-in-part of application No. PCT/CN2010/002168, filed on Dec. 27, 2010.

(30) Foreign Application Priority Data

Jul. 28, 2010 (CN) ..... 2010 1 0238156

(51) Int. Cl.

| | |
|---|---|
| ***F04D 17/10*** | (2006.01) |
| ***F04D 25/06*** | (2006.01) |
| ***F04D 27/00*** | (2006.01) |

(Continued)

(52) U.S. Cl.

CPC ..... *F04D 17/10* (2013.01); *F04D 17/127* (2013.01); *F04D 19/024* (2013.01); *F04D 25/0606* (2013.01); *F04D 27/007* (2013.01); *F04D 27/0292* (2013.01); *F04D 29/4213* (2013.01); *F04D 29/444* (2013.01); *F05D 2250/51* (2013.01); *F05D 2250/52* (2013.01)

(58) Field of Classification Search

CPC ..... F04D 17/10; F04D 17/12; F04D 17/127; F04D 19/024; F04D 19/026; F04D 25/0606; F04D 29/286; F04D 29/287; F04D 29/442; F04D 29/444; F04D 29/321; F04D 29/326; F04D 13/12

See application file for complete search history.

(56) References Cited

U.S. PATENT DOCUMENTS 4,122,668 A * 10/1978 Chou ..... F01D 21/006 188/290

FOREIGN PATENT DOCUMENTS

DE EP 0348342 A1 * 4/1989 ..... F04D 31/00
JP 2010106746 A * 5/2010

*Primary Examiner* — Christopher Verdier
*Assistant Examiner* — Juan G Flores
(74) *Attorney, Agent, or Firm* — Matthias Scholl, PC; Matthias Scholl

(57) ABSTRACT

A centrifugal compressor, including: a housing, the housing including: an inlet, a flow channel, an impeller outlet, and an air diffusing channel; a centrifugal impeller disposed inside the housing; a rotating wall, the rotating wall including a front cascade; and a rotating disc, the rotating disc including a rear cascade. The impeller outlet is disposed adjacent to a rear part of the centrifugal impeller and is connected to the flow channel via the air diffusing channel. The rotating wall is disposed between the centrifugal impeller and the housing. The front cascade is disposed inside the front part of the rotating wall and is connected to a dynamic driving device. The rotating disc is disposed inside the housing adjacent to the air diffusing channel and is in a rigid connection with the rotating wall.

12 Claims, 9 Drawing Sheets

(51) Int. Cl.

| | | | |
|---|---|---|---|
| ***F04D 29/44*** | (2006.01) | ***F04D 17/12*** | (2006.01) |
| ***F04D 27/02*** | (2006.01) | ***F04D 19/02*** | (2006.01) |
| | | ***F04D 29/42*** | (2006.01) |

CENTRIFUGAL COMPRESSOR

CROSS-REFERENCE TO RELATED APPLICATIONS

This application is a continuation-in-part of International Patent Application No. PCT/CN2010/002168 with an international filing date of Dec. 27, 2010, designating the United States, and further claims priority benefits to Chinese Patent Application No. 201010238156.5 filed Jul. 28, 2010. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a compression device for an internal combustion engine, and more particularly to a centrifugal compressor for a vehicular turbocharger.

2. Description of the Related Art

In recent years, as the power of the vehicular engines increases, much higher requirements have been imposed on the pressure ratio of centrifugal compressors in turbochargers than ever before. However, restricted by the size, the conventional turbocharger can only employ a single centrifugal impeller to process the air. When the compressor operates at a working condition of high rotational speed, strategies of acquiring a higher pressure ratio by improving the rotational speed is restricted by the intensity of the impeller materials; whereas when the compressor operates at a working condition of low rotational speed, the compressor has a low responsibility and a low pressure ratio. Thus, to improve the pressure in the inlet of the motor by improving the pressure ratio of the conventional centrifugal compressor is largely limited.

As shown in FIG. 1, a typical centrifugal compressor for a turbocharger includes: a housing 1, a centrifugal impeller 2, and an air diffusing channel 9. In an ordinary working condition, the centrifugal impeller 2 rotates at a high rotational speed under the drive of a turbine shaft 13, so that the fresh air is drawn into the compressor via an inlet 4 and compressed by a centrifugal force. The compressed air flows into the air diffusing channel 9, and part of a kinetic energy is converted into pressure energy. At the same time, the air flows into an air flow channel 14 via the air diffusing channel 9, and consequently reaches the internal combustion chamber via an outlet of the compressor. In the whole process, only the centrifugal impeller 2 does work on the air, which is very limited. Furthermore, because the size limitation, it is difficult to develop a multiple compression technology. Thus, a compression device, which not only has a size more or less the same as the conventional, but also effectively improves the pressure ratio and a responsibility at low speed, is desired.

SUMMARY OF THE INVENTION

In view of the above-described problems, it is one objective of the invention to provide a compression device which can effectively improve the pressure ratio and the response at a low speed.

To achieve the above objective, in accordance with one embodiment of the invention, there is provided a centrifugal compressor, comprising: a housing, the housing comprises:

an inlet, a flow channel, an impeller outlet, and an air diffusing channel; a centrifugal impeller disposed inside the housing; a rotating wall, the rotating wall comprising a front cascade; and a rotating disc, the rotating disc comprising a rear cascade. The centrifugal compressor is characterized in that:

the impeller outlet is disposed adjacent to a rear part of the centrifugal impeller, and connected to the flow channel via the air diffusing channel;

the rotating wall is disposed between the centrifugal impeller and the housing, the front cascade is disposed inside a front part of the rotating wall and connected to a dynamic driving device; and the rotating disc is disposed inside the housing adjacent to the air diffusing channel and is in rigid connection with the rotating wall.

In a class of this embodiment, an axial section of the rotating wall is in a shape of a dumbbell.

In a class of this embodiment, the rotating wall comprises a rear wall in a rear part. The air diffusing channel comprises a diffusing wall. The rear wall of the rotating wall is disposed in the air diffusing channel, and a shape of the rear wall is the same as a shape of the diffusing wall.

In a class of this embodiment, a sliding block is disposed between the rotating wall and the housing. The sliding block comprises: an inner side, and an outer side. The inner side of the sliding block is an arc surface matching with a shape of an outer surface of the rotating wall; and the outer side of the sliding block matches with a shape of an inner surface of the housing. The sliding block is in rigid connection with the housing.

In a class of this embodiment, the dynamic driving device comprises a motor; the motor comprises: a rotor, and a stator; the stator is fixed inside the inlet via a supporting device; and the rotor comprises a motor shaft.

In a class of this embodiment, the supporting device comprises: a supporting disc, and a fixing support arranged on an outer side of the supporting disc. A disc hub is disposed on a center of the supporting disc; and the stator is disposed on a center of the disc hub.

In a class of this embodiment, the front cascade comprises: a cascade hub, and a plurality of front blades. The cascade hub is connected to and driven by the motor shaft. One end of each front blade is arranged on an outer of the cascade hub, the other end of each front blade is in rigid connection with the rotating wall.

In a class of this embodiment, the front blade is in a shape of an aerofoil. The front blade comprises: a front edge, and a rear edge. The front edge bends towards a rotary direction of the cascade hub, and the rear edge is in parallel with an axis of the cascade hub.

In a class of this embodiment, the rear cascade comprises a plurality of rear blades which are radially arranged on the rotating disc.

In a class of this embodiment, the rear blade comprises: a windward side, and a lee side. The windward side is an arc surface, and the lee side is a flat surface.

In a class of this embodiment, the rear blade comprises: a front edge, and a rear edge. A connecting line between a center of the front edge and a center of the rear edge and a connecting line between the front edge and a center of the rotating disc form an angle, the angle is 30-70°.

Principle of the centrifugal compressor of the invention is as follows:

The front cascade is driven by the motor, and draws the fresh air around the inlet into the air channel inside the compressor, and the first work on the fresh air is done. The centrifugal impeller rotates at a high speed driven by the turbine shaft, and does a second work on the fresh air, and at the same time the direction of the air flow is changed from an axial direction to a radial direction. Then the air from the centrifugal impeller is drawn to the rear cascade, which is also driven by the motor, and a third work on the air is performed by the centrifugal impeller. Finally, the air flows into an internal combustion engine at a high pressure after being done work for three times, so that the supercharging of the combustion engine is achieved.

Compared with the conventional centrifugal compressor of the same size and the same rotational speed, the centrifugal compressor of the invention can perform work on the air for three times, thereby effectively improving the pressure ratio. In the meanwhile, to achieve the same pressure ratio as the conventional centrifugal compressor, a much lower rotational speed of the centrifugal impeller of the invention is needed. Thus, the centrifugal compressor is very significant in solving problems in the material intensity of the impeller in the high supercharging field.

Furthermore, the front and the rear cascades are driven by the motor, and are independently of the centrifugal impeller, thus, when the internal combustion engine is at low working condition and the centrifugal impeller cannot rotate at a high speed driven by the turbine shaft, difficulties in supercharging can be effectively solved by controlling the rotational speed of the motor, and at the same time the instantaneous responsibility of the compressor is improved.

BRIEF DESCRIPTION OF THE DRAWINGS

The invention is described hereinbelow with reference to the accompanying drawings, in which.

Figure 1:
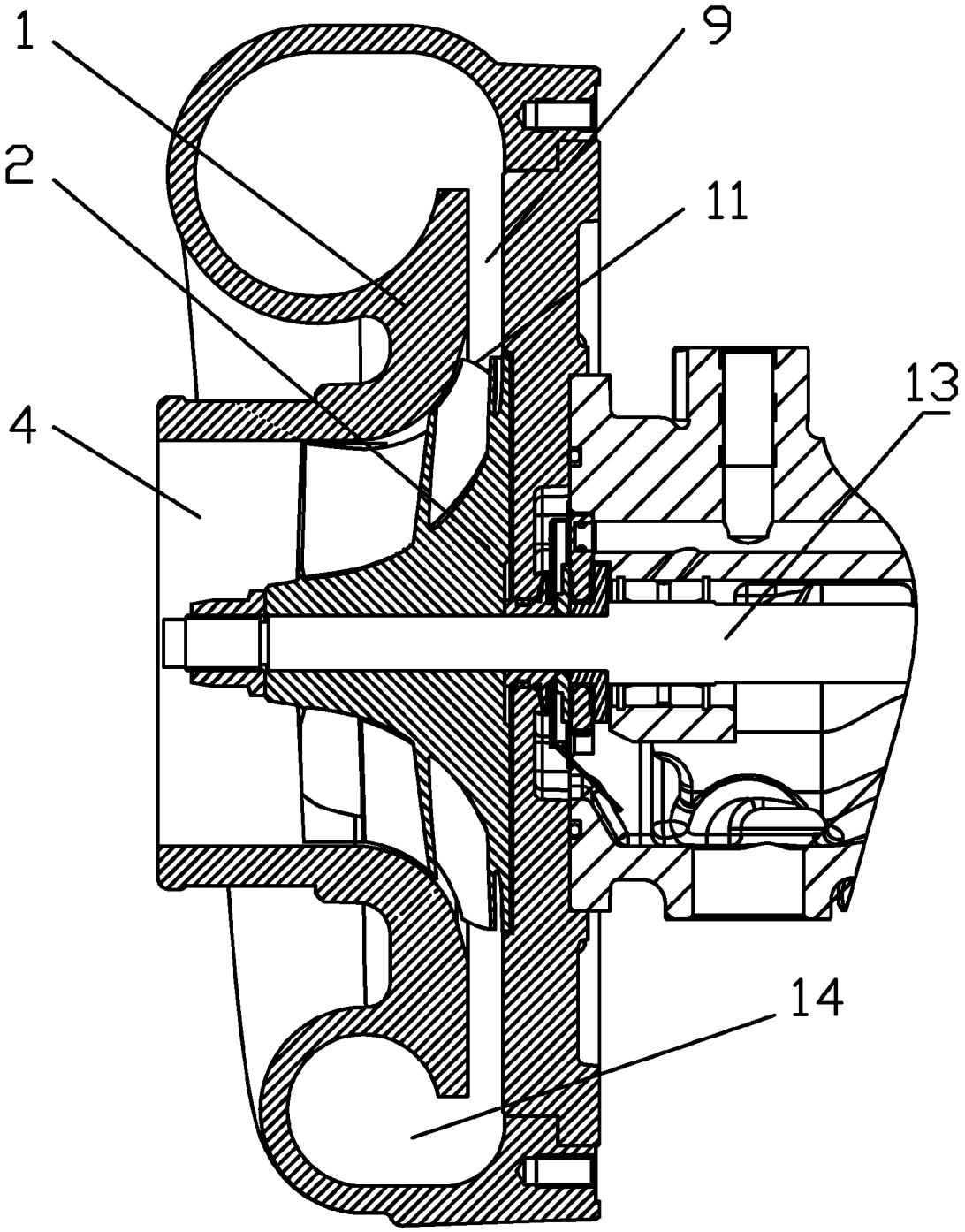
FIG. 1 (Prior art)
FIG. 1 is a structure diagram of a conventional centrifugal compressor for a turbocharger.

In the drawings, the following reference numbers are used: 1. Housing; 2. Centrifugal impeller; 3. Lug boss; 4. Inlet; 5. Front blade; 7. Rear wall of a rotating wall; 8. Second diffusing wall; 9. Air diffusing channel; 10. First diffusing wall; 11. Impeller outlet; 12. Rear blade; 13. Turbine shaft; 14. Flow channel; 15. Sliding block; 16. Fixing bolt; 17. Rotor; 18. Supporting disc; 19. Fixing pin; 20. Motor shaft; 21. Front cascade; 22. Cascade hub; 23. Stator; 24. Rotating disc; 25. Rear cascade; 26. Rolling bearing; 27. Motor; 28. Rotating wall; 29. Fixing support; 30. Disc hub; 31. Inner side of a sliding block; 32. Front wall of a rotating wall; 33. Outer side of a sliding block; 34. Front edge of a front blade; 35. Rear edge of a front blade; 36. Front edge of a rear cascade; and 37. Rear edge of a rear cascade.

DETAILED DESCRIPTION OF THE EMBODIMENTS

For further illustrating the invention, experiments detailing a centrifugal compressor are described below. It should be noted that the following examples are intended to describe and not to limit the invention.

Example 1

Figure 2:
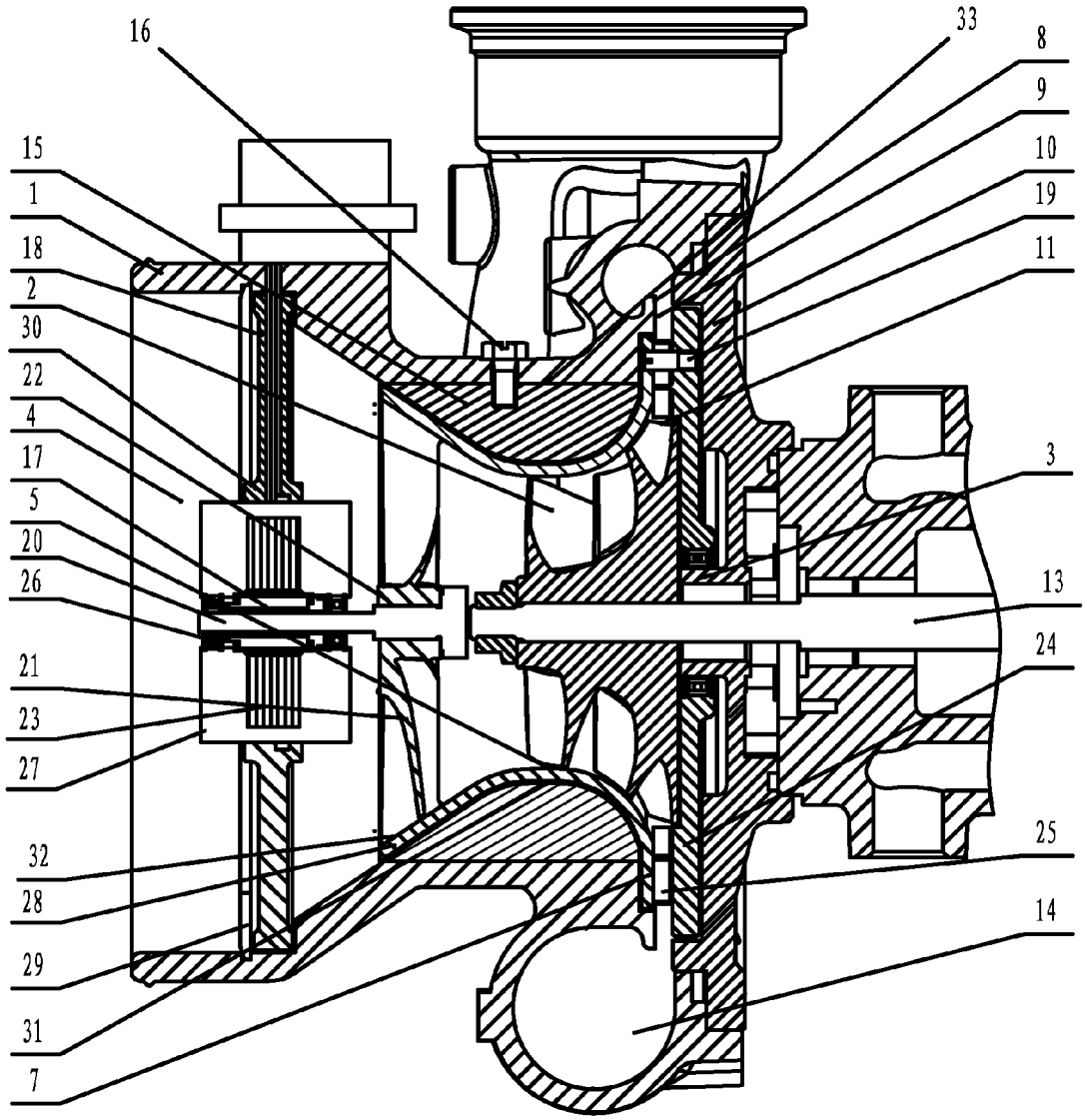
FIG. 2 is a structure diagram of a centrifugal compressor in accordance with Example 1 of the invention.

As shown in FIG. 2, a centrifugal compressor comprises a housing 1. The housing 1 comprises: a flow channel 14, an inlet 4, an impeller outlet 11, and an air diffusing channel 9. A turbine shaft 13 is disposed inside the housing 1, and the centrifugal impeller 2 is mounted on the turbine shaft 13. The impeller outlet 11 is disposed adjacent to a rear part of the centrifugal impeller 2 and connected to the flow channel 14 via the air diffusing channel 9.

A rotating wall 28 is disposed between the centrifugal impeller 2 and the housing 1, and an axial section of the rotating wall 28 is in a shape of a dumbbell. A front cascade 21 is disposed inside a front wall of the rotating wall 28 and is in rigid connection with a dynamic driving device.

A rotating disc 24 is disposed inside the housing 1 adjacent to the air diffusing channel 9, and in rigid connection with the rotating wall 28. A rear cascade 25 is arranged on the rotating disc 24.

A first diffusing wall 10 is arranged inside the housing 1 adjacent to the air diffusing channel 9; a groove is arranged on one side of the first diffusing wall 10 adjacent to the air diffusing channel 9; and the rotating disc 24 is disposed in the groove.

One end of the rotating wall extends to the inlet 4 of the housing, and forms a front wall 32 of the rotating wall connected with the front cascade 21; the other end of the rotating wall extends radially, and forms a rear wall 7. The front wall 32 of the rotating wall and the front cascade 21 are welded together. The air diffusing channel 9 comprises a second diffusing wall 8, the rear wall 7 of the rotating wall is disposed in the air diffusing channel 9, and the shape of the rear wall 7 has the same shape of that of the air diffusing channel 9. A gap between the rear wall 7 of the rotating wall and the rear cascade 25 is controlled at 0.4 mm below.

The dynamic driving device comprises a motor 27 fixed inside the inlet 4. The motor 27 comprises: a rotor 17, and a stator 23. The stator 23 is fixed inside the inlet 4 via a supporting device, and the rotor 17 comprises a motor shaft 20.

The motor shaft 20 is connected to the motor 27 via a rolling bearing 26. A stopping ring is disposed on two sides of the rolling bearing 26. The rolling bearing 26 comprises independent sliding structures and sealing structures.

To ensure the motor shaft 17 coaxially rotates with the turbine shaft 13, the supporting device comprises: a supporting disc 18, and 4 fixing supports 29 disposed outside the supporting disc 18. A disc hub 30 is arranged on a center of the supporting disc 18, and the stator 23 is disposed on the disc hub 30.

Holes are arranged on the disc hub 30 for mounting bolts and fixing the motor 27.

To ensure an enough large air channel, a diameter of the inlet 4 is 1.5-2 times of a diameter of the centrifugal impeller 2.

A sliding block 15 is disposed in a position between the rotating wall 28 and the housing 1. The sliding block 15 is composed of two parts, and the two parts form a circle. The sliding block 15 is fixed on the housing 1 by fixing blots 16. Thus, it is very convenient to assemble the rotating wall 28.

To ensure a coaxial rotation between the rotating disc 24 and the turbine shaft 13, and a low relative speed thereof, a lug boss 3 is designed on the first diffusing wall 10, and the lug boss 3 is in a shape of a cylinder.

The sliding block 15 comprises: an inner side 31, and an outer side 33. The inner side 31 of the sliding block 15 is an arc surface matching with a shape of an outer surface of the rotating wall 28; and the outer side 33 of the sliding block 15 matches with a shape of an inner surface of the housing 1. A diameter of the outer side 33 of the sliding block 15 is no less than a diameter of an inlet of the rotating wall 28.

Gaps are formed between the rotating wall 28 and the inner side 31 of the sliding block 28, and between the housing 1 and the centrifugal impeller 2, and both the gaps are less than 0.4 mm.

Figure 3:
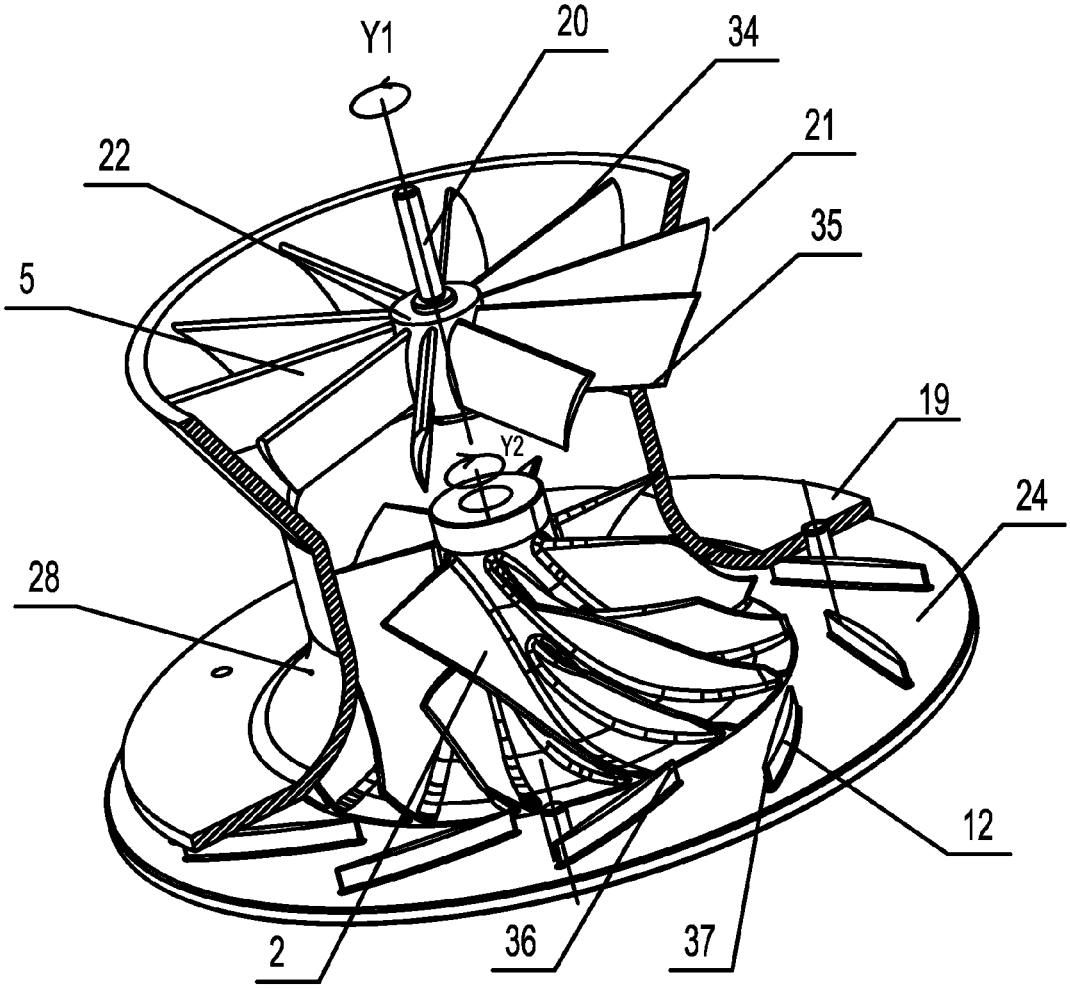
FIG. 3 is a spatial structure diagram of a front cascade, a rotating wall, a centrifugal impeller, a rear cascade, and a first diffusing wall in accordance with Example 1.
Figure 4:
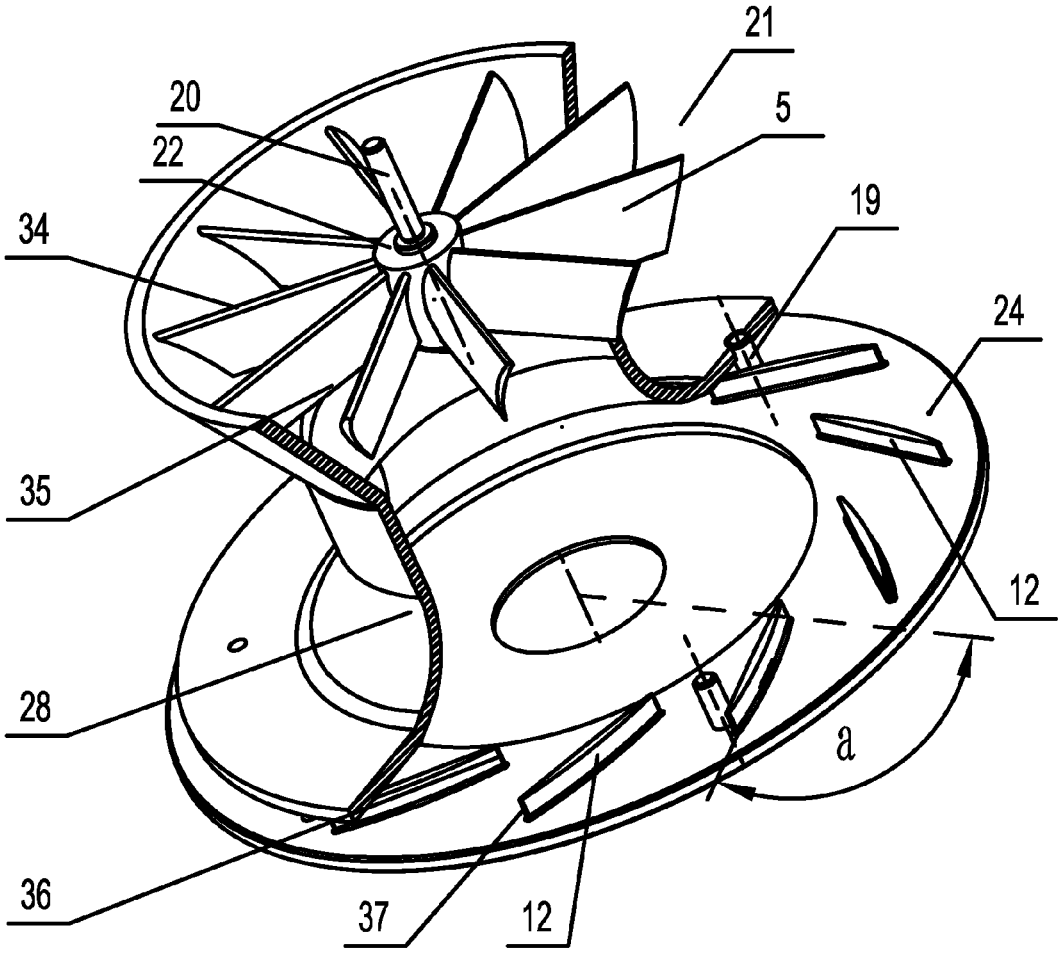
FIG. 4 is a spatial structure diagram of a front cascade, a rotating wall, a rear cascade, and a rotating disc in accordance with Example 1.

As shown in FIGS. 3 and 4, the front cascade 21 comprises: a cascade hub 22, and a plurality of front blades 5. The cascade hub 22 is connected to and driven by the motor shaft 20. One end of each front blade 5 is arranged on an outer of the cascade hub 22, and the other end of each front blade 5 is in rigid connection with the rotating wall 28.

The front blade 5 is in a shape of an aerofoil, and comprises: a front edge 34, and a rear edge 35. The front edge 34 bends towards a rotary direction of the cascade hub 22, and the rear edge 35 is in parallel with an axis of the cascade hub 22.

Figure 5:
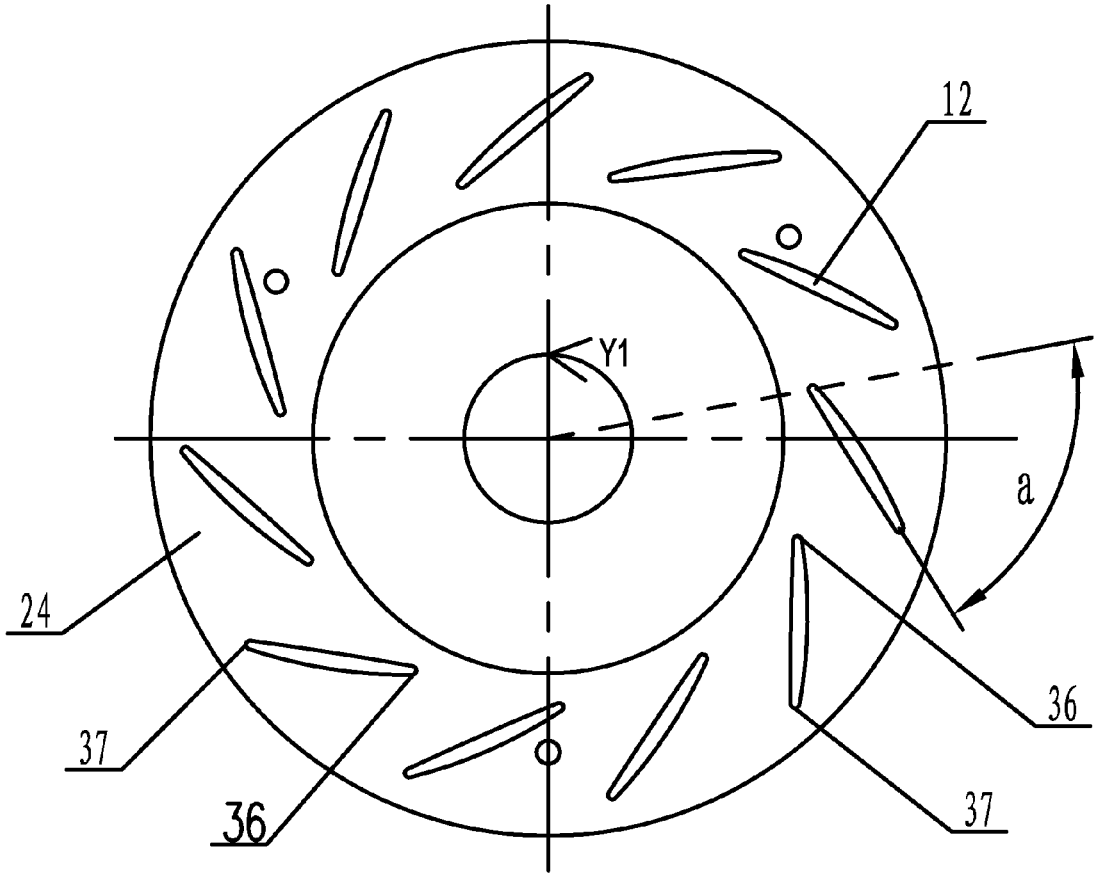
FIG. 5 is a structure diagram of a rear cascade and a rotating disc in accordance with Example 1.

As shown in FIG. 5, the rear cascade 25 comprises a plurality of rear blades 12 which are radially arranged on the rotating disc 24.

Figure 6:
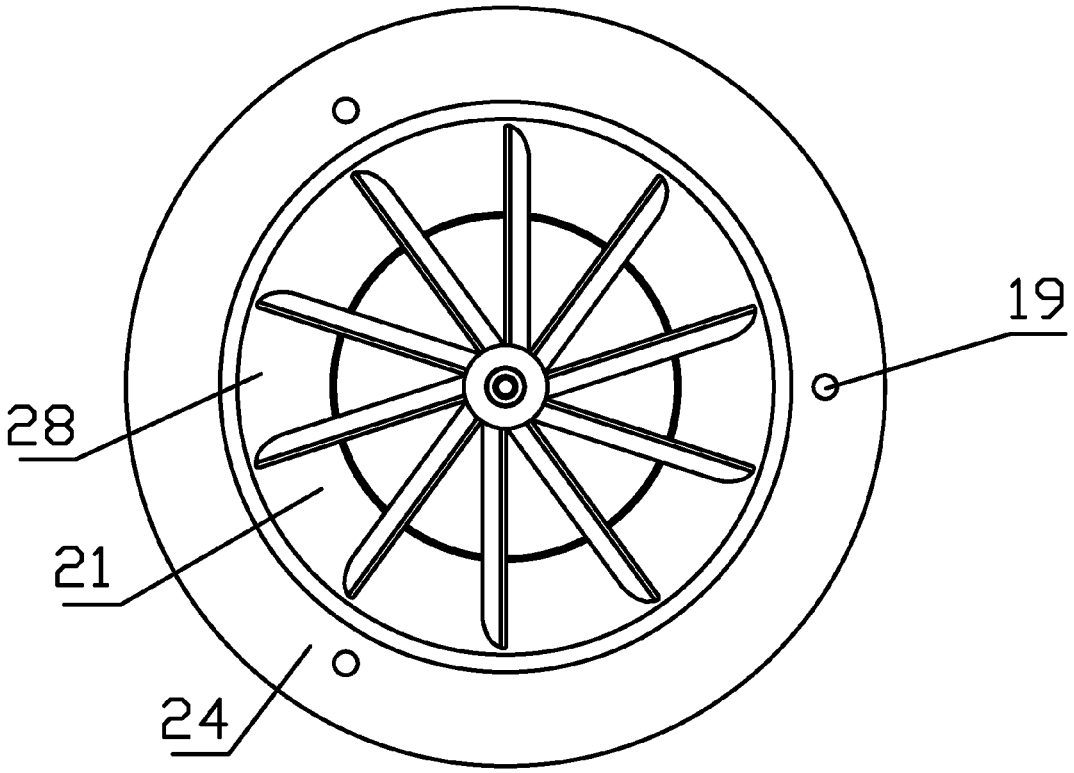
FIG. 6 is a structure diagram of a front cascade, a rotating wall, and a rotating disc in accordance with Example 1.

As shown in FIG. 6, an outer diameter of the rotating disc 24 is no less than an outer diameter of the rear wall 7 of the rotating wall. The rotating disc 24 and the rotating wall 28 are fixed together by fixing pins 19.

To ensure the air flow from the cascade outlet has the same absolute rotary direction as the centrifugal impeller 2, a ratio of the rotational speed of the motor and the rotational speed of the turbine shaft is controlled at 0-⅓.

As shown in FIG. 3, the turbine shaft 13 rotates along Y2 direction. The front cascade 21, the rotating wall 28, the rear cascade 25, and the rotating disc 24 are driven by the motor shaft 24 and are coaxially in relative rotation with the turbine shaft 13, the rotary direction of the motor shaft 24 is Y1.

Each rear blade 12 comprises: a windward side, and a lee side; the windward side is an arc surface, and the lee side is a flat surface.

As shown in FIG. 5, the rear blade 12 comprises: a front edge 36, and a rear edge 37. The front edge 36 is inclined towards the rotary direction Y1. A connecting line between a center of the front edge 36 and a center of the rear edge 37 and a connecting line between the front edge 36 and a center of the rotating disc 24 form an angle $\alpha$, the angle $\alpha$ is 30-70°.

Base on a relative same size as the conventional centrifugal compressor, the invention has achieved the relative rotation between the front cascade 21 and the centrifugal impeller 2, and the structure improvements of the centrifugal impeller 2 and the rear cascade 25, so that the fresh air in the centrifugal compressor are counter rotated for twice and done work for three times, which effectively increases the pressure ratio. The centrifugal compressor of the invention has a simply structure and is acquired based on similar materials and the conventional casting and processing techniques.

Example 2

The present example is different from Example 1 only in mounting angles of the front blades 5 and the rear blades 12.

Figure 7:
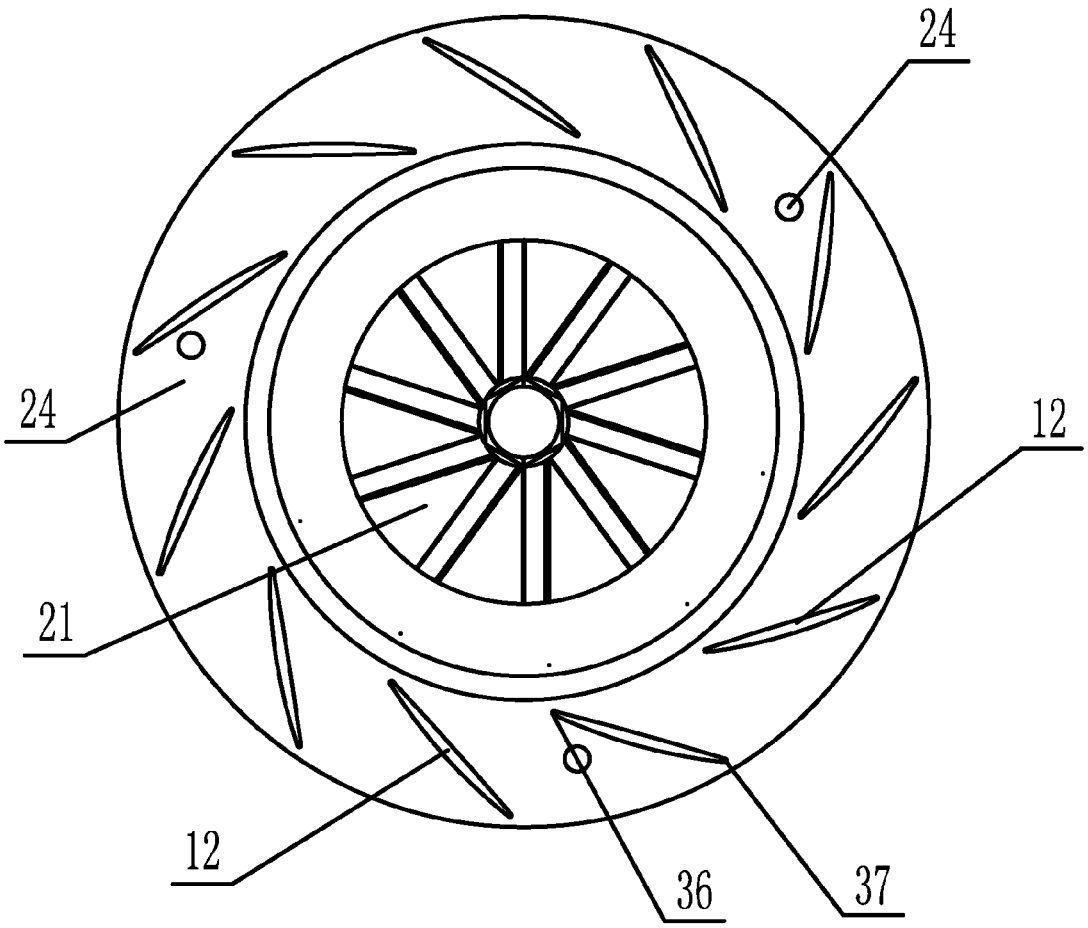
FIG. 7 is a rear view of FIG. 5.

As shown in FIG. 7, the front cascade 21, the rotating wall 28, the rear cascade 25, and the rotating disc 24 are driven by the motor shaft 20, and rotate in the same rotary direction as the turbine shaft. In correspondingly, mounting angles of the front cascade 21 and the rear cascade 25 are adjusted. Structures of other components are the same as Example 1.

Figure 8:
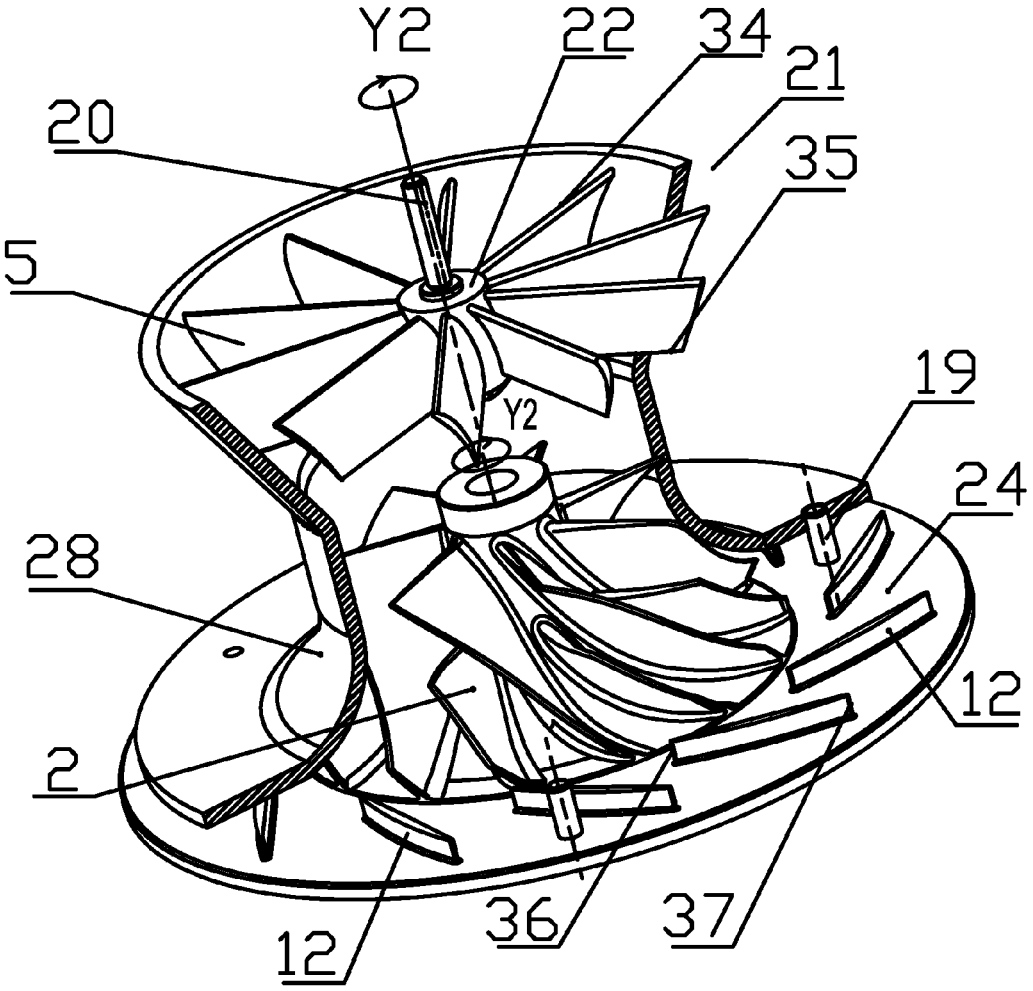
FIG. 8 is a spatial structure diagram of a front cascade, a rotating wall, a centrifugal impeller, a rear cascade, and a first diffusing wall in accordance with Example 2.

As shown in FIG. 8, the turbine shaft 13 rotates along a Y2 direction. The front blades 21, the rotating wall 28, the rear blades 12, and the rotating disc 24 are driven by the motor shaft 20 and coaxially rotate in the same direction as the turbine shaft 13, that is, the rotary direction of the motor shaft 20 is also Y2.

Figure 9:
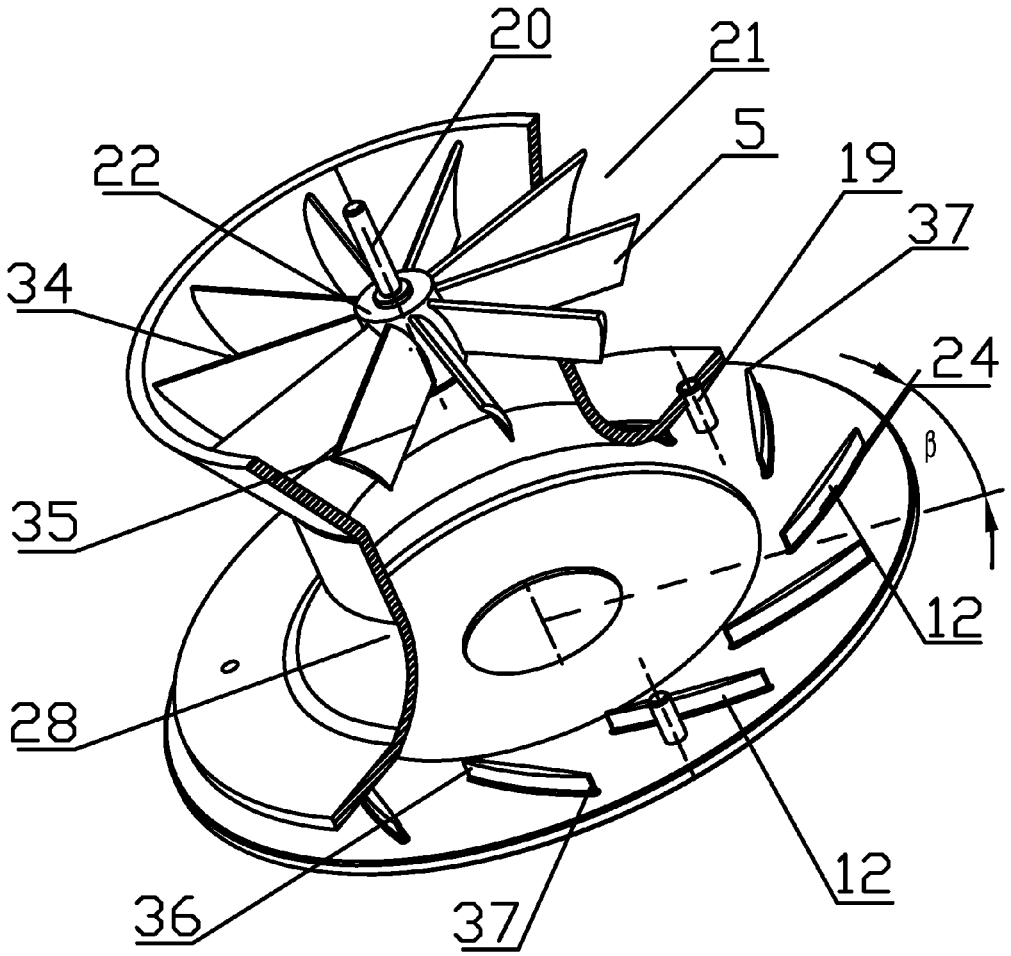
FIG. 9 is a spatial structure diagram of a front cascade, a rotating wall, a rear cascade, and a rotating disc in accordance with Example 2.

As shown in FIG. 9, each front blade 5 is in a shape of an aerofoil, and comprises: a front edge 34, and a rear edge 35. The front edge 34 bends towards a rotary direction of the cascade hub 22, and the rear edge 35 is in parallel with an axis of the cascade hub 22.

Each rear blade 12 comprises: a windward side, and a lee side; the windward side is an arc surface, and the lee side is a flat surface.

The front edge 36 of the rear blade 12 is inclined towards the rotary direction Y2. A connecting line between a center of the front edge 36 and a center of the rear edge 37 and a connecting line between the front edge 36 and a center of the rotating disc 24 form an angle $\beta$, which is 30-70°.

Base on a relative same size as the conventional centrifugal compressor, the front cascade 21, the centrifugal impeller 2, and the rear cascade 25 do work on the air, and effectively increases the pressure ratio. The centrifugal compressor of the invention has a simply structure and is acquired based on similar materials and the conventional casting and processing techniques.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A centrifugal compressor, comprising:

a) a housing, the housing comprising an inlet, a flow channel, an impeller outlet, and an air diffusing channel;

b) a centrifugal impeller disposed inside the housing;

c) a rotating wall, the rotating wall comprising a front cascade; and d) a rotating disc, the rotating disc comprising a rear cascade;

wherein:

the impeller outlet is disposed adjacent to a rear part of the centrifugal impeller and is connected to the flow channel via the air diffusing channel;

the rotating wall is disposed between the centrifugal impeller and the housing;

the front cascade is disposed inside a front part of the rotating wall and is connected to a dynamic driving device;

the rotating disc is disposed inside the housing adjacent to the air diffusing channel and is in rigid connection with the rotating wall;

the rotating wall comprises a rear wall in a rear part;

the air diffusing channel comprises a diffusing wall;

the rear wall of the rotating wall is disposed in the air diffusing channel, and a shape of the rear wall is the same as a shape of the diffusing wall;

the dynamic driving device comprises a motor;

the motor comprises a rotor, and a stator;

the stator is fixed inside the inlet via a supporting device; and the rotor comprises a motor shaft.

2. The centrifugal compressor of claim 1, wherein:

the front cascade comprises a cascade hub and a plurality of front blades;

the cascade hub is connected to and driven by the motor shaft; and one end of each front blade is arranged on an outer of the cascade hub, and the other end of each front blade is in rigid connection with the rotating wall.

3. The centrifugal compressor of claim 1, wherein the rear cascade comprises a plurality of rear blades which are radially arranged on the rotating disc.

4. The centrifugal compressor of claim 3, wherein the rear blade comprises a windward side, and a lee side; the windward side is an arc surface, and the lee side is a flat surface.

5. The centrifugal compressor of claim 4, wherein:

the rear blade comprises a front edge and a rear edge; and a connecting line between a center of the front edge and a center of the rear edge and a connecting line between the front edge and a center of the rotating disc form an angle, and the angle is 30-70°.

6. The centrifugal compressor of claim 1, wherein:

the supporting device comprises a supporting disc and a fixing support arranged on an outer side of the supporting disc;

a disc hub is disposed on a center of the supporting disc; and the stator is disposed on a center of the disc hub.

7. A centrifugal compressor, comprising:

a) a housing, the housing comprising an inlet, a flow channel, an impeller outlet, and an air diffusing channel;

b) a centrifugal impeller disposed inside the housing;

c) a rotating wall, the rotating wall comprising a front cascade; and d) a rotating disc, the rotating disc comprising a rear cascade;

wherein:

the impeller outlet is disposed adjacent to a rear part of the centrifugal impeller and is connected to the flow channel via the air diffusing channel;

the rotating wall is disposed between the centrifugal impeller and the housing;

the front cascade is disposed inside a front part of the rotating wall and is connected to a dynamic driving device;

the rotating disc is disposed inside the housing adjacent to the air diffusing channel and is in rigid connection with the rotating wall;

an axial section of the rotating wall is in a shape of a dumbbell;

the rotating wall comprises a rear wall in a rear part;

the air diffusing channel comprises a diffusing wall;

the rear wall of the rotating wall is disposed in the air diffusing channel, and a shape of the rear wall is the same as a shape of the diffusing wall;

the dynamic driving device comprises a motor;

the motor comprises a rotor, and a stator;

the stator is fixed inside the inlet via a supporting device; and the rotor comprises a motor shaft.

8. The centrifugal compressor of claim 7, wherein:

the front cascade comprises a cascade hub and a plurality of front blades;

the cascade hub is connected to and driven by the motor shaft; and one end of each front blade is arranged on an outer of the cascade hub, and the other end of each front blade is in rigid connection with the rotating wall.

9. The centrifugal compressor of claim 7, wherein the rear cascade comprises a plurality of rear blades which are radially arranged on the rotating disc.

10. The centrifugal compressor of claim 9, wherein the rear blade comprises a windward side, and a lee side; the windward side is an arc surface, and the lee side is a flat surface.

11. The centrifugal compressor of claim 10, wherein:

the rear blade comprises a front edge and a rear edge; and a connecting line between a center of the front edge and a center of the rear edge and a connecting line between the front edge and a center of the rotating disc form an angle, and the angle is 30-70°.

12. The centrifugal compressor of claim 7, wherein:

the supporting device comprises a supporting disc and a fixing support arranged on an outer side of the supporting disc;

a disc hub is disposed on a center of the supporting disc; and the stator is disposed on a center of the disc hub.

* * * * *